US007632083B2

(12) United States Patent
Hosono

(10) Patent No.: US 7,632,083 B2
(45) Date of Patent: Dec. 15, 2009

(54) ANTI-GALLING PUMP ROTOR FOR AN INTERNAL GEAR PUMP

(75) Inventor: Katsuaki Hosono, Niigata (JP)

(73) Assignee: Mitsubishi Materials PMG Corp., Niigata-Shi, Niigata-Ken (JP)

( * ) Notice: Subject to any disclaimer, the term of this patent is extended or adjusted under 35 U.S.C. 154(b) by 141 days.

(21) Appl. No.: 11/816,788

(22) PCT Filed: Nov. 14, 2005

(86) PCT No.: PCT/JP2005/020803

§ 371 (c)(1),
(2), (4) Date: Aug. 21, 2007

(87) PCT Pub. No.: WO2006/090516

PCT Pub. Date: Aug. 31, 2006

(65) Prior Publication Data

US 2008/0213117 A1 Sep. 4, 2008

(30) Foreign Application Priority Data

Feb. 22, 2005 (JP) ..... 2005-045461

(51) Int. Cl.
*F01C 21/00* (2006.01)
*F03C 2/00* (2006.01)
*F04C 2/00* (2006.01)

(52) U.S. Cl. ..... 418/179; 418/171; 418/178

(58) Field of Classification Search ..... 418/166, 418/171, 178, 179, 201.1, 206.1
See application file for complete search history.

(56) References Cited

U.S. PATENT DOCUMENTS 3,695,791 A * 10/1972 Brundage ..... 418/171
3,918,923 A * 11/1975 Inoue ..... 75/246
5,618,171 A 4/1997 von Behr et al.
6,264,718 B1 * 7/2001 Akagi et al. ..... 75/246
2008/0232994 A1 * 9/2008 Hosono ..... 418/191

FOREIGN PATENT DOCUMENTS

JP 53058807 A * 5/1978 ..... 418/178
JP 60147589 A * 8/1985 ..... 418/179
JP 02207187 A * 8/1990 ..... 418/201.1

(Continued)

*Primary Examiner*—Theresa Trieu
(74) *Attorney, Agent, or Firm*—Darby & Darby, P.C.

(57) ABSTRACT

In pump rotors and used in an internal gear pump, which includes an inner pump rotor having outer gear teeth; an outer pump rotor having inner gear teeth that mesh with the outer gear teeth ; and a casing having a pumping-in port through which a fluid is pumped in, and a pumping-out port through which the fluid is pumped out, and pumps in and pumps out the fluid by changing the cell volume formed between gear tooth surfaces of the rotors and so as to carry the fluid when the rotors and mesh with each other and rotate, the rotors are formed from a sintered material of Fe—Cu—C and have a density of not less than 6.6 g/cm$^3$ and not more than 7.1 g/cm$^3$, and the outer circumferential surface of the outer pump rotor and the end surfaces perpendicular to rotation axes of the rotors and are non-grinded surface and have a ten point height of irregularities Rz of not less than 4 μm and not more than 10 μm.

2 Claims, 9 Drawing Sheets

FOREIGN PATENT DOCUMENTS

| | | | | |
|---|---|---|---|---|
| JP | 05-256268 | A | 10/1993 | |
| JP | 10-331777 | A | 12/1998 | |
| JP | 11-343985 | A | 12/1999 | |
| JP | 2002-138968 | A | 5/2002 | |
| JP | 2003-286970 | A | 10/2003 | |
| JP | 2004-011641 | A | 1/2004 | |
| JP | 2004-197670 | A | 7/2004 | |
| KR | 10-0385747 | | 8/2003 | |
| WO | WO 2004030852 | A1 * | 4/2004 | ..... 474/152 |

* cited by examiner

ANTI-GALLING PUMP ROTOR FOR AN INTERNAL GEAR PUMP

CROSS REFERENCE TO RELATED APPLICATIONS

This application is the national phase under 35 U.S.C. §371 of PCT International Application No. PCT/JP2005/020803, which has an international filing date of Nov. 14, 2005, designated in the United States and claim priority from Japanese Patent Application No. 2005-045461, filed Feb. 22, 2005. International Application No. PCT/JP2005/020803 and Japanese Patent Application No. 2005-045461 are incorporated by reference herein in their entireties.

TECHNICAL FIELD

The present invention relates to a pump rotor used in an internal gear pump that pumps in and pumps out fluid by changing the cell volume formed between gear tooth surfaces of an inner pump rotor and an outer pump rotor.

BACKGROUND ART OF THE INVENTION

This type of pump rotor has been widely used in an internal gear pump such as lubricant oil pump, oil pump for automatic transmission or the like in a vehicle (for example, refer to Japanese Unexamined Patent Application, First Publication No. H11-343985). The internal gear pump includes an inner pump rotor having outer gear teeth; an outer pump rotor having inner gear teeth that mesh with the outer gear teeth; and a casing having a pumping-in port, through which fluid is pumped in, and a pumping-out port, through which the fluid is pumped out. The internal gear pump pumps in and pumps out the fluid by changing the cell volume formed between gear tooth surfaces of the rotors so as to carry the fluid when the rotors mesh with each other and rotate. In addition, the rotors mesh with each other and rotate while both end surfaces of the rotors in the direction of the rotation axes and an outer circumferential surface of the outer pump rotor slide on an inner surface of the casing.

Meanwhile, the internal gear pump, in general, is disposed between a fluid (for example, lubricant oil) supplier (for example, cylinder head) and an oil pan, which stores the fluid, and communicates with the oil pan through a strainer. When the internal gear pump is activated, the fluid in the oil pan is supplied to the inside of the internal gear pump from the strainer, and pumped in and pumped out by changing the cell volume in the internal gear pump, as described above, so as to be supplied to the cylinder head or the like.

SUMMARY OF THE INVENTION

Meanwhile, when an internal gear pump is activated, the lubricating ability between an inner surface of a casing and both end surfaces of both rotors in a direction of rotation axes, and the inner surface of the casing and an outer circumferential surface of an outer pump rotor is provided by fluid supplied to the inside of the pump from an oil pan. That is, generally, no device is provided separately in order to supply lubricant oil for the lubricating ability inside of the internal gear pump.

As a result, when the internal gear pump is reactivated, no lubricant oil exists or only a small amount of lubricant oil exists, if any, between the inner surface of the casing and the end surfaces, and the inner surface of the casing and the outer circumferential surface of the outer pump rotor. Thereby, the lubricating ability between the inner surface of the casing and the end surfaces, and the inner surface of the casing and the outer circumferential surface are rarely secured. Therefore, the pump rotor can easily be galled when the internal gear pump is repeatedly used.

The present invention was conceived in view of the above described problem points and it is an object thereof to provide a pump rotor having an improved anti-galling.

In order to achieve the above object, a pump rotor according to the present invention is a pump rotor used in an internal gear pump including an inner pump rotor having outer gear teeth; an outer pump rotor having inner gear teeth that mesh with the outer gear teeth; and a casing having a pumping-in port, through which a fluid is pumped in, and a pumping-out port, through which the fluid is pumped out, the pump rotor pumping in and pumping out the fluid by volume change of cells formed between gear tooth surfaces of the rotors so as to carry the fluid when the rotors mesh with each other and rotate, wherein the pump rotor is formed from a sintered material of Fe—Cu—C and has a density not less than 6.6 $g/cm^3$ and not more than 7.1 $g/cm^3$, and at least an outer circumferential surface of the outer pump rotor and both end surfaces perpendicular to rotation axes of the rotors are non-grinded surfaces and have ten point height of irregularities Rz not less than 4 μm and not more than 10 μm.

According to the present invention, since the outer circumferential surface of the outer pump rotor and the end surfaces perpendicular to the rotation axes of the rotors, which slide on the inner surface of the casing when the internal gear pump is activated, are non-grinded surfaces and have the ten point height of irregularities not less than 4 μm and not more than 10 μm, part of the fluid pumped into the inside of the internal gear pump during activation can be retained at the outer circumferential surface and the end surfaces when the internal gear pump stops after activation. That is, when the internal gear pump stops, a part of the fluid can be retained at fine holes on the non-grinded surfaces, that is, part of the fluid can be absorbed into the surface portions of the outer circumferential surface and the end surfaces. Therefore, the part of the fluid can act as the lubricant oil between the inner surface of the casing and the outer circumferential surface of the outer pump rotor, and the inner surface of the casing and the end surfaces of the rotors when the internal gear pump is reactivated after stopped, and thus the anti-galling of the pump rotor can be improved.

In addition, since the pump rotor is formed from a sintered material of Fe—Cu—C and has a density not less than 6.6 $g/cm^3$ and not more than 7.1 $g/cm^3$, the breaking strength and surface durability of the pump rotor can be secured to the minimum necessary value. In this case, the pump rotor is fabricated by pressure forming, sintering, and sizing. The pump rotor is formed from the above material and has the above density; therefore, collapses of intersecting ridge portions between the end surfaces and the gear tooth surfaces of the pump rotor can be prevented from expanding due to crushing of the intersecting ridge portions during the sizing process. As a result, it is possible to suppress the leakage of the fluid in the cells from the intersecting ridge portions to a gap between the end surfaces and the inner surface of the casing when the internal gear pump is activated and to make the cells divided by the intersecting ridge portions, the gear tooth surfaces, and the inner surface of the casing have high liquid-tightness.

In this case, it is desirable that the intersecting ridge portions between the end surfaces and the gear tooth surfaces have a rising amount of 0.01 mm or less in the direction of the rotation axes from the end surfaces and a protruding amount of 0.05 mm or less in the radius direction from the gear tooth surfaces.

In this case, it is possible to make the intersecting ridge portions into contact with the inner surface of the casing in the internal gear pump having the pump rotors since the intersecting ridge portions have the rising and protruding amounts in the above ranges. As a result, the cells are divided by the intersecting ridge portions, the gear tooth surfaces and the inner surface of the casing, thereby the cells can have high liquid-tightness, and thus the leakage of the fluid in the cells through a gap between the end surfaces and the inner surface of the casing can be assuredly suppressed when the internal gear pump is activated.

Furthermore, setting the rising amount in the above range result in making the intersecting ridge portions of the end surfaces be in contact with the inner surface of the casing; therefore, partial wear does not easily occur on the inner surface, and the lifespan of the internal gear pump can be prevented from being shortened.

Still furthermore, since the protruding amount is set in the above range, the intermediate portions of the rotors in the thickness direction can be in contact with each other when the teeth of the gears mesh with each other, while the intersecting ridge portions are in contact with each other. Therefore, the respective cells can be assuredly divided in the circumferential direction, and the fluid-carrying performance of the pump rarely deteriorates.

According to the present invention, the anti-galling property of the pump rotor can be improved.

DETAILED DESCRIPTION OF THE INVENTION

Hereinafter, an embodiment of the present invention will be described with reference to the accompanying drawings.

Figure 1:
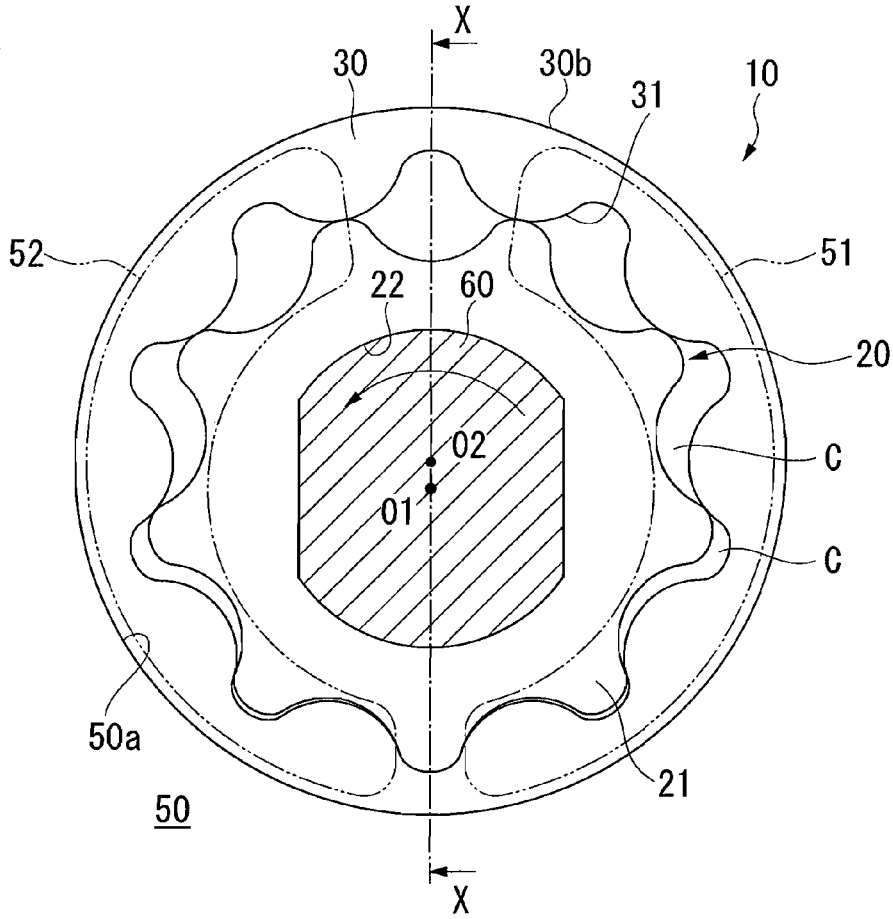
FIG. 1 is a cross-sectional plan view showing an internal gear pump having pump rotors shown as an embodiment of the present invention.
Figure 2:
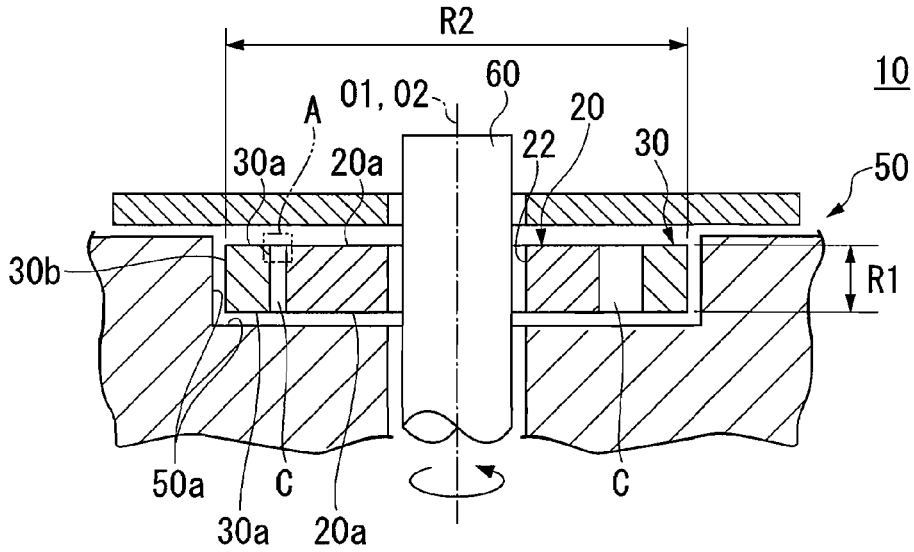
FIG. 2 is a cross-sectional view showing the internal gear pump taken along the line X-X in FIG. 1.
Figure 3:
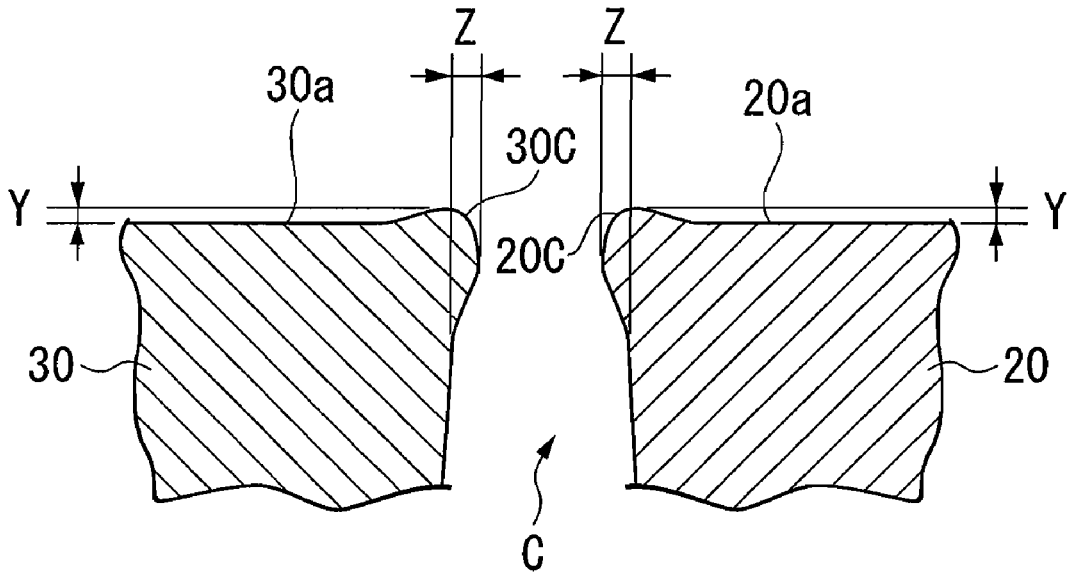
FIG. 3 is an enlarged view of the internal gear pump shown in FIG. 1.

An internal gear pump 10 shown in FIG. 1 includes an inner pump rotor 20 having "n" outer gear teeth 21 ("n" is a natural number, "n"=9 in the present embodiment); an outer pump rotor 30 having (n+1) (i.e., 10 in the present embodiment) inner gear teeth 31 that mesh with the outer gear teeth 21 respectively; and a driving shaft 60 inserted in an attaching hole 22 formed at the inner pump rotor 20. All components are stored in a casing 50.

A rotary driving force is transmitted to the attaching hole 22 by the rotation of the driving shaft 60 around an axis O1 thereof, and the inner pump rotor 20 also rotates around the axis O1. In addition, the outer gear teeth 21 mesh with the inner gear teeth 31 so as to transmit the rotary driving force of the rotor 20 to the outer pump rotor 30; thereby the rotor 30 rotates around an axis O2 of the rotor 30.

In this case, the rotors 20 and 30 rotate while both end surfaces of the rotors 20 and 30 in the rotation axes O0 and O2, that is, the end surfaces 20*a* and 30*a* perpendicular to the rotation axes O1 and O2 and an outer circumferential surface 30*b* of the outer pump rotor 30 are in contact with an inner surface 50*a* of the casing 50.

In this case, a plurality of cells C are formed along the rotating direction of the rotors 20 and 30 between the gear tooth surfaces of the inner pump rotor 20 and the outer pump rotor 30. The cells C are divided separately at the front and rear sides of the rotating direction of the rotors 20 and 30 by the outer gear teeth 21 of the inner pump rotor 20 are contact with the inner gear teeth 31 of the outer pump rotor 30 respectively, and both side surfaces are divided by the inner surface of the casing 50, thereby fluid-carrying chambers are formed separately. In addition, the rotation of the rotors 20 and 30 accompanies the rotational moving of the cells C; and the volume of the cells C continuously increases and decreases on a cycle of one rotation.

The casing 50 includes a pumping-in port 51 which communicates with the cells C when the volume of the cells C increases, and a pumping-out port 52 which communicates with the cells C when the volume of the cells C decreases, and the fluid pumped into the cells C through the pumping-in port 51 is carried and pumped out through the pumping-out port 52 while the rotors 20 and 30 rotate.

In this case, the rotors 20 and 30 according to the present embodiment are formed from a sintered material of Fe—C—Cu containing at least Cu not less than 1% and not more than 4% by weight and C not less than 0.2% and not more than 1.0% by weight, for example, Fe-0.7C-2.0Cu, Fe-0.8C-1.5Cu-4.0Ni-0.5Mo or the like. If Cu is less than 1% by weight, solid-solution hardening of Fe (hardness, strength) is not sufficient; and if Cu is more than 4% by weight, the expansion during a sintering process is greatly, therefore, the rotor is hard to shape with a high precision. If C is less than 0.2% by weight, solid-solution hardening of Fe (hardness, strength) is not sufficient; and if C is more than 1.0% by weight, the fluidity of the powder deteriorates during the powder shaping, therefore, it becomes impossible to form the rotor uniformly in density throughout the entire area.

In addition, the rotors 20 and 30 have a density of not less than 6.6 g/cm$^3$ and not more than 7.1 g/cm$^3$, and at least the outer circumferential surface 30*b* of the outer pump rotor 30 and the end surfaces 20*a* and 30*a* of the rotors 20 and 30 in the direction of the rotation axes O1 and O2 are non-grinded surface having ten point height of irregularities Rz of not less than 4 μm and not more than 10 μm. Furthermore, the rotors 20 and 30 have porosity of not less than 10% and not more than 20%.

In the present embodiment, the entire outer surfaces of the rotors 20 and 30, including the end surfaces 20*a* and 30*a* and the outer circumferential surface 30*b*, are non-grinded surfaces and have the ten point height of irregularities Rz in the above range. In addition, fluctuations of distances (thickness) R1 between the end surfaces 20*a* and 20*a*, and 30*a* and 30*a* in the rotors 20 and 30 are not less than 0.02 mm and not more than 0.10 mm throughout the respective end surfaces 20*a* and 30*a*.

Meanwhile, a fluctuation of an outer diameter R2 of the outer pump rotor 30 is not less than 0.06 mm and not more than 0.15 mm. In addition, the difference between the inner diameter of the inner surface 50*a* of the casing 50 and the outer diameter R2 of the outer pump rotor 30 is not less than 0.06 mm and not more than 0.35 mm, and the differences between the depth of the inner surface 50*a* of the casing 50 and the thickness R1 of the rotors 20 and 30 are not less than 0.02 mm and not more than 0.10 mm.

Furthermore, in the present embodiment, intersecting ridge portions 20*c* and 30*c* between the end surfaces 20*a* and 30*a* and the gear tooth surfaces have a rising amount Y of 0.01 mm or less in the direction of the rotation axes O1 and O2 from the end surfaces 20*a* and 30*a* and a protruding amount Z of 0.05 mm or less in the radius direction from the gear tooth surfaces in the respective rotors 20 and 30. That is, the respective intersecting ridge portions 20*c* and 30*c* have the rising amount Y and the protruding amount Z in the above ranges, and the intersecting ridge portion 20*c* protrudes outward in the radius direction with a curved surface and the intersecting ridge portion 30*c* protrudes inward in the radius direction with a curved surface.

Next, a manufacturing method of the inner pump rotor 20 and the outer pump rotor 30 having the above structure will be described. The rotors 20 and 30 are manufactured as follows: powder is compression-shaped to produce a green compact. The green compact is sintered and then performed a sizing. After that, the rotors 20 and 30 are obtained by removing burrs without surface grinding. Hereinafter, a shaping method of the green compact will be described.

FIGS. 5 to 8 show important parts of a powder-shaping device 100 that shapes the green compact. In these drawings, reference symbol 110 is an upper punch, reference symbol 120 is a lower punch, reference symbol 130 is a core rod, reference symbol 140 is a die, reference symbol 150 is a shoebox, reference symbol 160 is a measuring device that measures the distance between the punches (bottom dead point-adjusting linear scale), and P is a powder.

The die 140 includes a shaping hole, and the core rod 130 is disposed at the center of the shaping hole. A cylindrical space formed between the shaping hole and the core rod 130 is shut by the cylindrical lower punch 120 fitted from the bottom and the cylindrical upper punch 110 fitted from the top so as to form a cavity 100*a*. The material powder P is pressed in the cavity 100*a*, and thus a green compact Z1 (see FIG. 8) is shaped along the shape of the cavity 100*a*.

The shoebox 150 that fills the material powder P in the cavity 100*a* is shaped like a box with the bottom surface open and slides back-and-forth (right-and-left in the drawings) on an upper surface of the die 140 in a state in which a bottom surface thereof is in contact with the upper surface of the die 140. The material powder P is supplied from a hopper (not shown) into the shoebox 150. The shoebox 150 advances to a position shown in FIG. 5, under which the cavity 100*a* exits, and then falls the material powder P stored therein into the cavity 100*a*; and the cavity 100*a* is filled with the material powder P.

The upper punch 110 is fixed to an upper punch-supporting member 110A that is held by a platform 100*b* via a frame 170 so as to move vertically with respect to the plat form 100*b*, thereby the upper punch 110 can move vertically in conjunction with the upper punch-supporting member 110A. The upper punch-supporting member 110A being fixed the upper punch 110 is vertically driven mechanically by a mechanism (first driving device), for example, crank mechanism, knuckle press, cam mechanism or the like. The material powder P filled in the cavity 100*a* can be compressed by lowering the upper punch 100 down to the bottom dead point.

The lower punch 120 is fixed to a lower punch-supporting member 120A and can move vertically in conjunction with the lower punch-supporting member 120A by a piston 181 of a hydraulic cylinder 180 (second driving device) fixed to the platform 100*b*. A filling amount-adjusting linear scale 161 is attached between the lower punch 120 (lower punch-supporting member 120A) and the platform 100*b* in order to detect the position of the lower punch 120 from the platform 100*b*. When a control unit 190 receives detecting signals from the filling amount-adjusting linear scale 161, the control unit 190 controls the amount of fluid in the hydraulic cylinder 180 in order to move the piston 181, i.e., the lower punch 120 to a desired position.

The bottom dead point-adjusting linear scale (measuring device) 160 is fixed between the upper punch supporting member 110A and the lower punch supporting member 120A, and outputs measured values of the distance between the upper punch supporting member 110A and the lower punch supporting member 120A, that is, the space between the upper punch 110 and the lower punch 120 as signals. The control unit 190 which receives the signals stores previously determined target values, thereby, the control unit 190 controls the fluid flow in the hydraulic cylinder 180 to correlate the measured values with the target values.

The target value is set so that the thickness of the cavity 100*a* becomes the target thickness between the upper punch 110 and the lower punch 120.

In addition, shoebox position detecting signals are also inputted to the control unit 190. The shoebox position detecting signals are outputted from a shoebox position detecting sensor (not shown) and show the position of the shoebox 150.

Next, a shaping method of the green compact using the powder shaping device 100 having the above structure will be described.

First, the upper punch 110, the lower punch 120 and the die 140 are placed at the initial predetermined positions, respectively, before the pressure forming.

[Filling Process]

Figure 5:
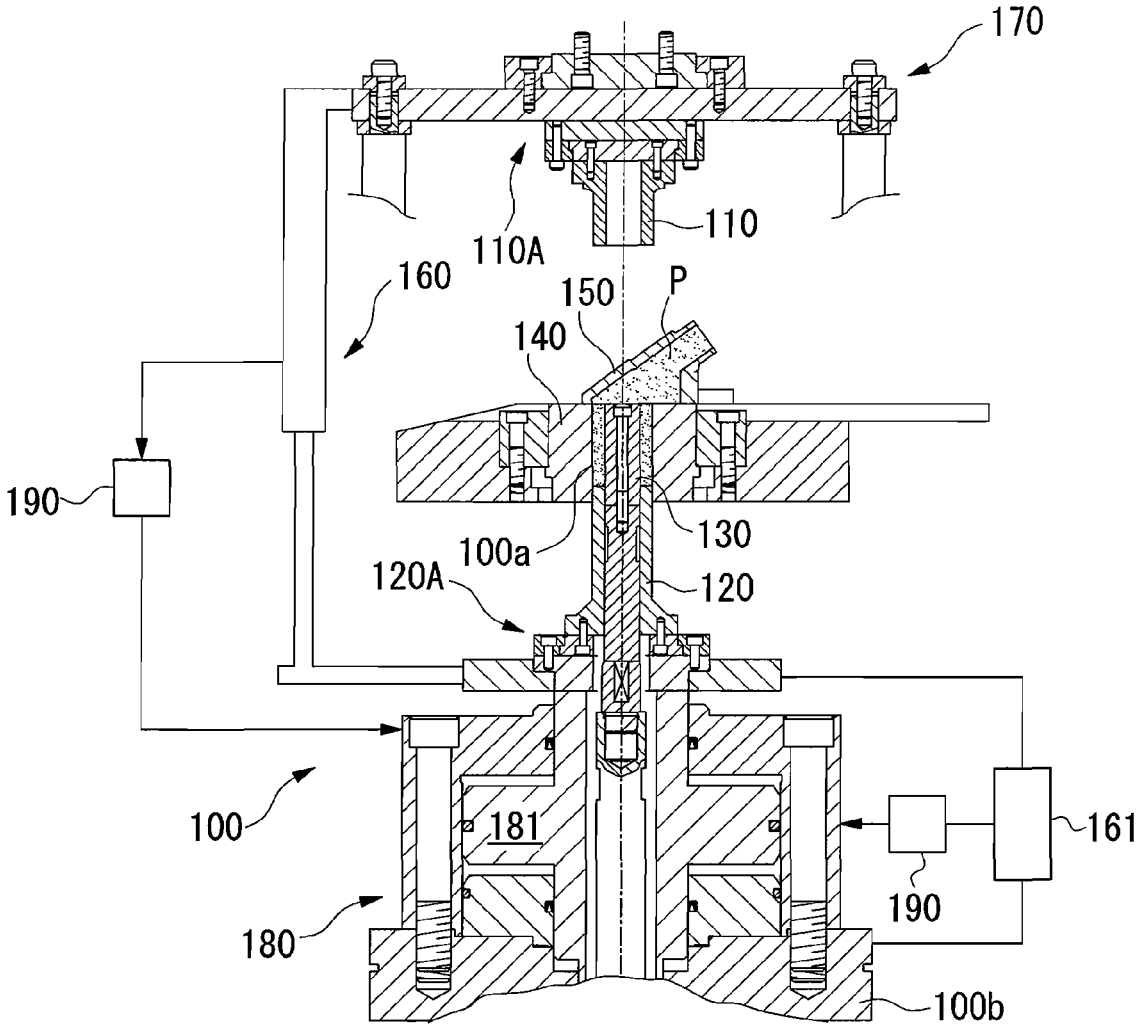
FIG. 5 is a cross-sectional view showing an embodiment of important parts of a powder-shaping device for shaping the pump rotor shown in FIG. 1 and is a description of a powder-filling process.

The shoebox 150 is advanced (advancing process) to a position shown in FIG. 5, under which the cavity 100*a* exists, and then the material powder P is filled in the cavity 100*a*. In this case, the shoebox 150 is advanced from the rear side (right in FIG. 5) to the front side (left in FIG. 5) so as to be placed at the position shown in FIG. 5, thereby the shoebox 150 opens above the cavity 100*a* at the rear side first, then at the front side. Therefore, due to the rear side of the cavity 100*a* facing the opening of the shoebox 150 for a longer time, the material powder P is filled into the cavity 100*a* with a higher density at the rear side.

Figure 6:
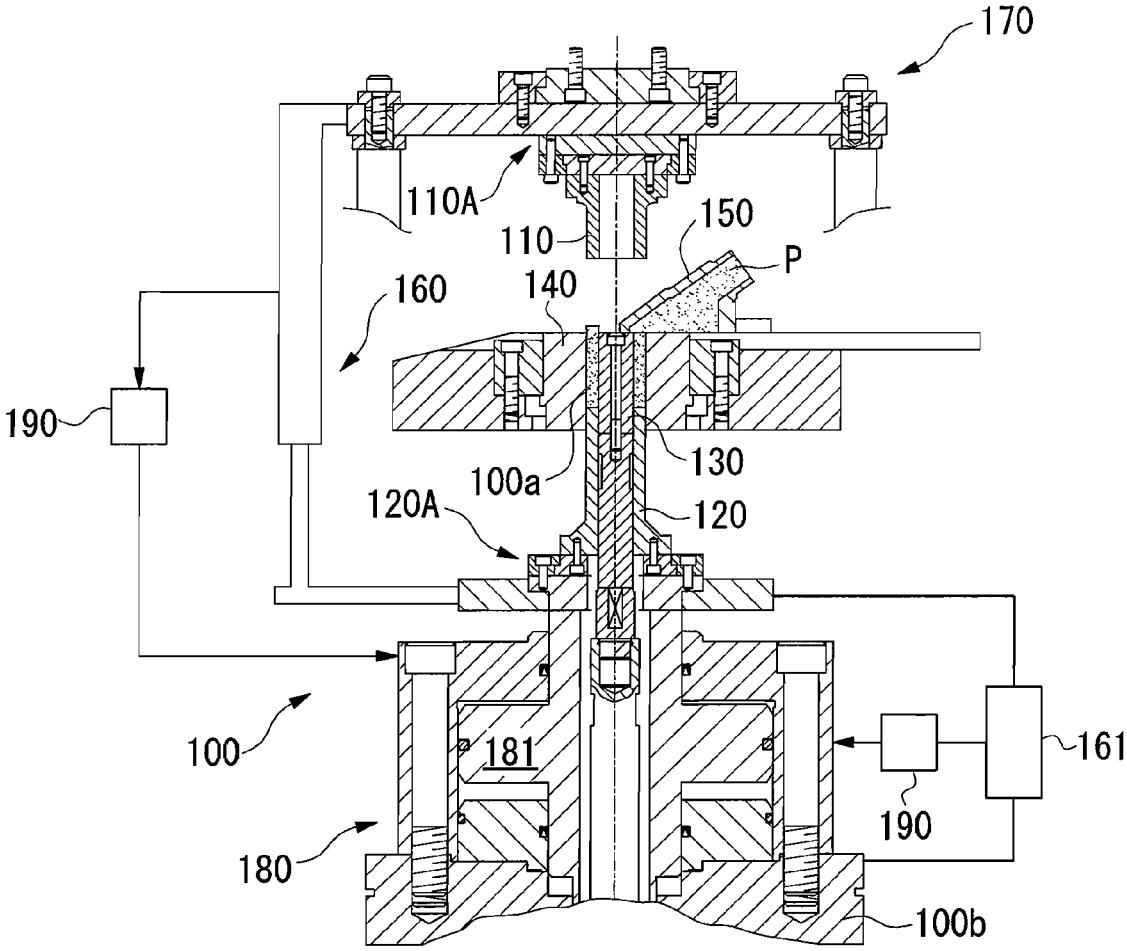
FIG. 6 is a view showing a lower punch elevation process in a retreating process of a shoebox in the powder-shaping device shown in FIG. 5.

Next, as shown in FIG. 6, while retreating the shoebox 150 from the position, under which the cavity 100*a* exists (retreating process), the lower punch 120 is moved up with respect to the die 140 at the initial stage of the retreating process. That is, when surplus material powder P existing on the die 140 and the core rod 130 is removed by the front wall of the shoebox 150 while the shoebox 150 retreats, part of the material powder P filled in the rear side of the cavity 100*a* is pushed up on the die 140 by the lower punch 120 moving up after the front wall of the shoebox 150 retreats from the front side of the cavity 100*a* and then removed by the shoebox 150. Therefore, the amount of the material powder P filled in the cavity 100*a* is adjusted at the front and rear sides of the cavity 100*a*. As a result, the volume of the material powder P becomes large at the front side of the cavity 100*a* and small at the rear side of the cavity 100*a*.

Figure 7:
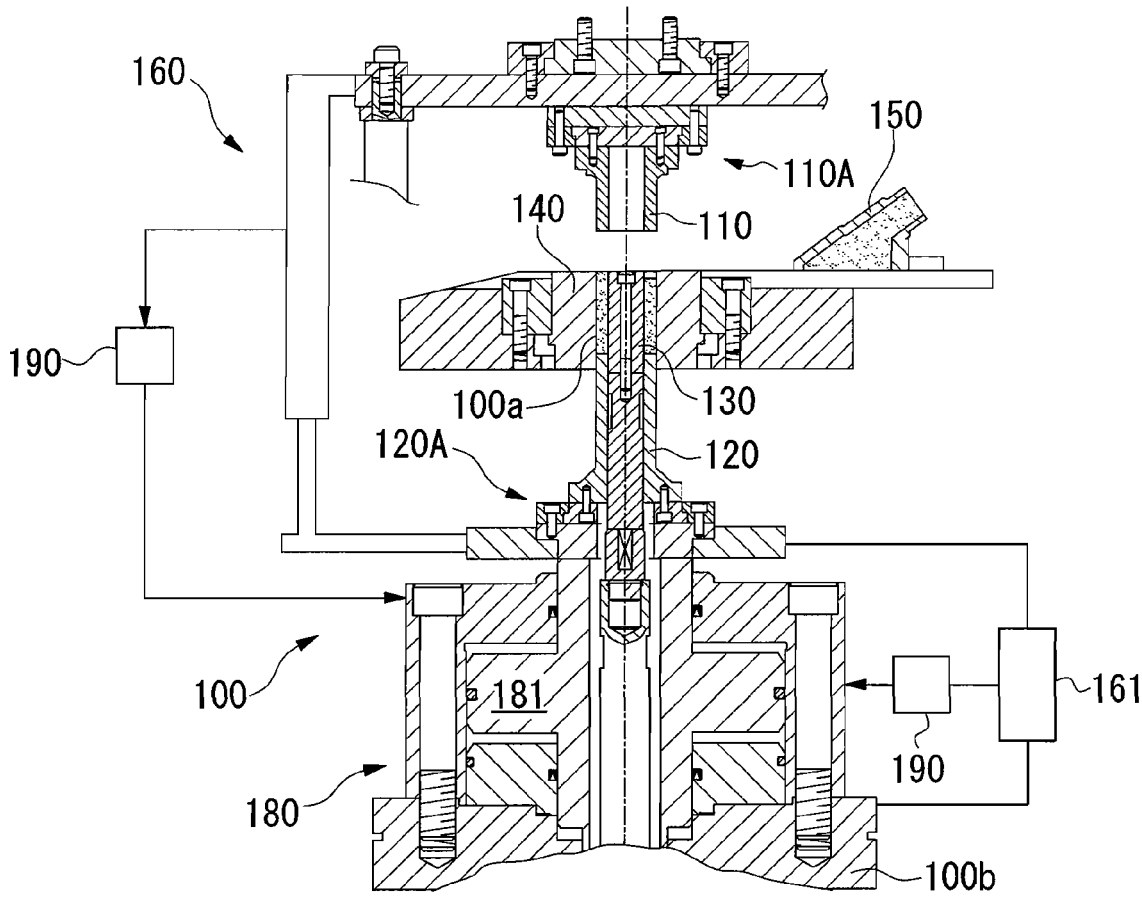
FIG. 7 is a cross-sectional view showing important parts of the powder-shaping device when the lower punch is moved down from a state shown in FIG. 6 and the powder is filled.

In addition, as shown in FIG. 7, the moved-up lower punch 120 is moved down away with respect to the die 140 and placed back to the initial position after the shoebox 150 is retreated from the position, under which the cavity 100*a* exists, completely. As a result, the material powder P that was pushed up upper than the die 140 at the front side of the cavity 100*a* is filled back in the cavity 100*a* (i.e., the die 140), and thus the material powder P filled in the cavity 100*a* is high at the front side and low at the rear side.

That is, since the material powder P falls from the shoebox 150 by gravity so as to fill the cavity 100*a*, the rear side of the cavity 100*a* faces the opening of the shoebox 150 for a longer time, thereby a larger amount of material powder P is filled at the rear side of the cavity 100*a*. As a result, when the powder is evenly high throughout the cavity 100*a*, the rear side of the cavity 100*a* is filled with a larger amount of material powder P; therefore the density of the green compact is not uniform when the material powder P is compressed in such a state.

Contrary to the above, in the present embodiment, the material powder P is filled higher at the front side having a low density and lower at the rear side having a high density. Therefore, the filling amount of the material powder P along the moving direction of the shoebox 150 can be balanced, and the material powder P is filled evenly throughout the cavity 100*a*.

[Punch-Driving Process]

FIG. 8 shows a pressure forming process, in which the upper and lower punches are driven.

(First Driving Process)

Figures 8A, 8B, 8C:
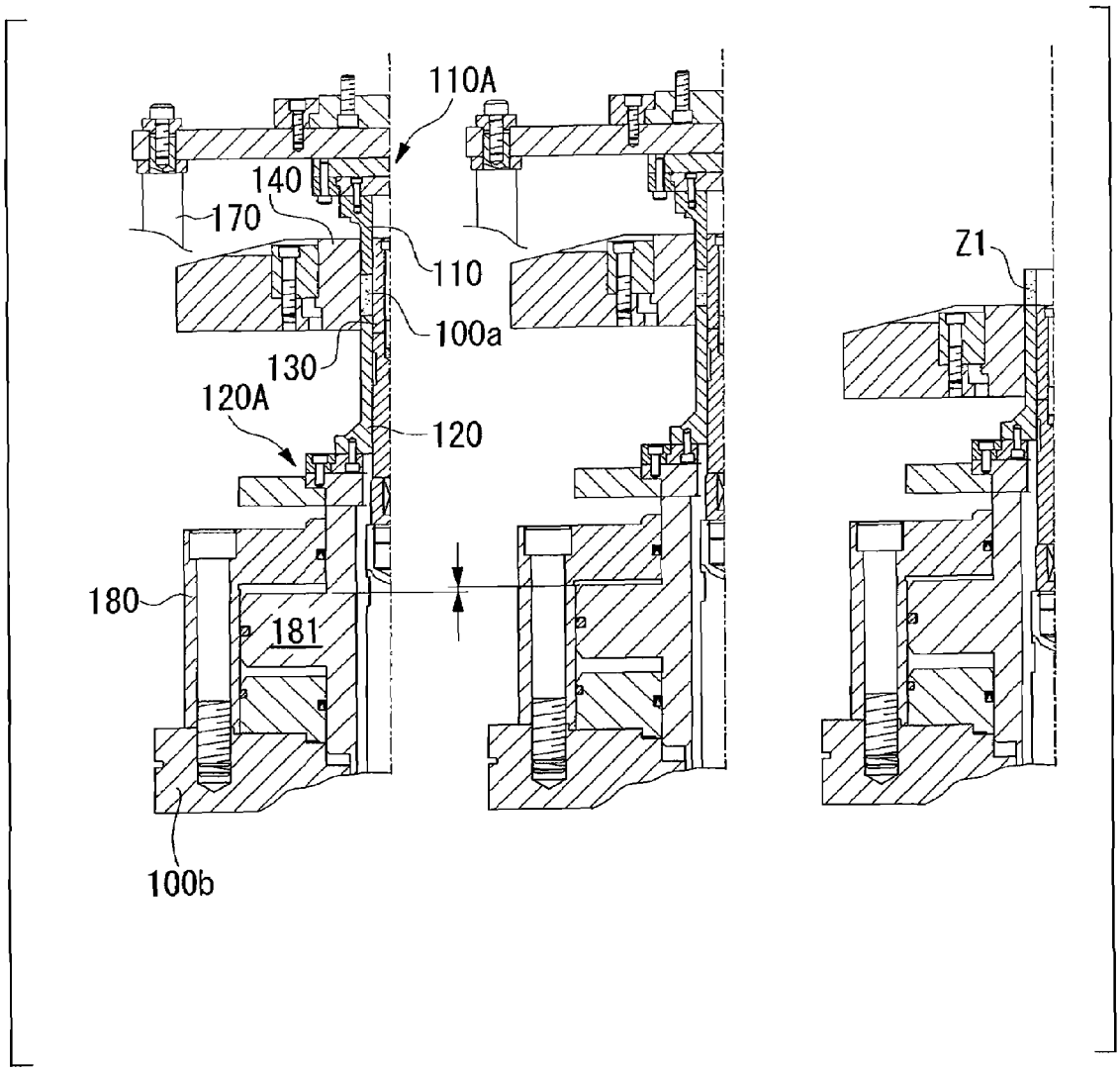
FIGS. 8A to 8C are cross-sectional views showing important parts of the powder-shaping device in FIGS. 5 to 7, showing a mechanical driving process, in which an upper punch is moved down to a bottom dead point, in FIG. 8A, an adjusting process, in which the lower punch is moved up until a thickness of a cavity becomes a target value, in FIG. 8B and a process of removing the green compact from a die in FIG. 8C.

First, as shown in FIG. 8A, the upper punch 110 is moved down to the bottom dead point (mechanically movable bottom position) while the lower punch 120 is fixed, and then the material powder P in the cavity 100*a* is compressed. Even though the upper punch 110 is designed to move down to the ideal bottom dead point in the device, in practice, it is impossible to move the upper punch 110 down to the ideal bottom dead point due to the flexure or the like of the device.

The ideal bottom dead point of the upper punch 110 is set at a point, at which the upper punch 110 and the lower punch 120 fixed to the initial position forms the cavity 100*a* therebetween, for example, about 1 mm thicker than the target thickness of the green compact. That is, the thickness of the cavity 100*a* is larger than the target thickness even when no flexure, elongation or the like of the device occurs and the upper punch 110 is moved down to the ideal bottom dead point; therefore the green compact thinner than the target thickness is not formed.

(Second Driving Process)

Next, as shown in FIG. 8B, the lower punch 120 is moved up from the initial position until the thickness of the cavity 100*a* becomes the target thickness by driving the fluid-pressure cylinder 180 while a crank that mechanically drives the upper punch 110 is stopped and the upper punch 110 is fixed to the bottom dead point. In this case, the lower punch 120 is moved up by feeding back the measured values measured by the bottom dead point-adjusting linear scale 160.

That is, the control unit 190 controls the amount of fluid in the hydraulic cylinder 180 when receiving the detecting signals from the filling amount-adjusting linear scale 161, and the space between the punches 110 and 120 is measured by the bottom dead point-adjusting linear scale 160. Then, the control unit 190 controls and drives the fluid-pressure cylinder 180 and moves the lower punch 120 up until the measured value reaches the target thickness.

In this case, sometimes, the upper punch 110 is slightly pushed up due to the lower punch 120 moving up. However, the lower punch 120 is moved up while the measured value of the space between the punches 110 and 120 is fed back, thereby the shortage of the moving amount of the upper punch 110 is offset by the lower punch 120 driven until the thickness of the cavity 100*a* reaches the target thickness, and thus the thickness of the green compact reaches the target value.

In addition, as shown in FIG. 8C, the upper punch 110 is moved up, and the core rod 130 and the die 140 are moved down with respect to the lower punch 120 so that the green compact Z1 is removed from the die 140. Furthermore, the lower punch 120 which was moved up in the second driving process is moved back to the initial position and is set to a state for forming the next green compact.

As described above, it is possible to obtain the green compact Z1 having the entirely uniform density and the target thickness.

Next, after burning, the green compact Z1 is performed a sizing process by a well-known method and reformed, and then burrs are removed without a surface-grinding process; thus the inner pump rotor 20 and the outer pump rotor 30 are formed.

According to the pump rotors 20 and 30 of the present embodiment described above, since at least the outer circumferential surface 30*b* of the outer pump rotor 30 and the end surfaces of the rotors 20 and 30 in the direction of the rotation axes O1 and O2, which are contact with the inner surface 50*a* of the casing 50 when the internal gear pump 10 is activated, are non-grinded surface having the ten point height of irregularities Rz not less than 4 (m and not more than 10 (m, part of the fluid pumped in to the inside of the pump during the activation can be retained at the outer circumferential surface 30*b* and the end surfaces 20*a* and 30*a* even when the internal gear pump 10 is stopped after the activation.

Figure 4A:
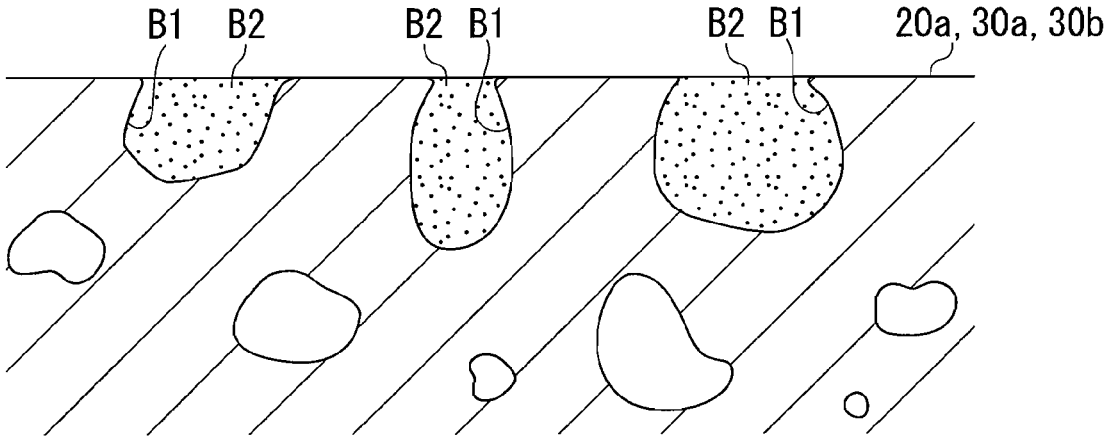
FIG. 4A is an enlarged cross-sectional view showing an outer circumferential surface of an outer pump rotor or both end surfaces of the outer pump rotor and an inner pump rotor shown as the embodiment of the present invention.

That is, when the internal gear pump 10 is stopped, part of the fluid B2 can be retained at fine holes B1 which open at the non-grinded surfaces, that is, part of the fluid B2 can be soaked into the surface portions of the outer circumferential surface 30*b* and the end surfaces 20*a* and 30*a* as shown in FIG. 4A. Therefore, the part of the fluid B2 exudes from the holes B1 and can act as lubricant oil between the inner surface 50*a* of the casing 50 and the outer circumferential surface 30*b* of the outer pump rotor 30, and the inner surface 50*a* of the casing 50 and the end surfaces 20*a* and 30*a* of the rotors 20 and 30 when the internal gear pump 10 is reactivated, and thus the anti-galling of the pump rotors 20 and 30 can be improved.

Figure 4B:
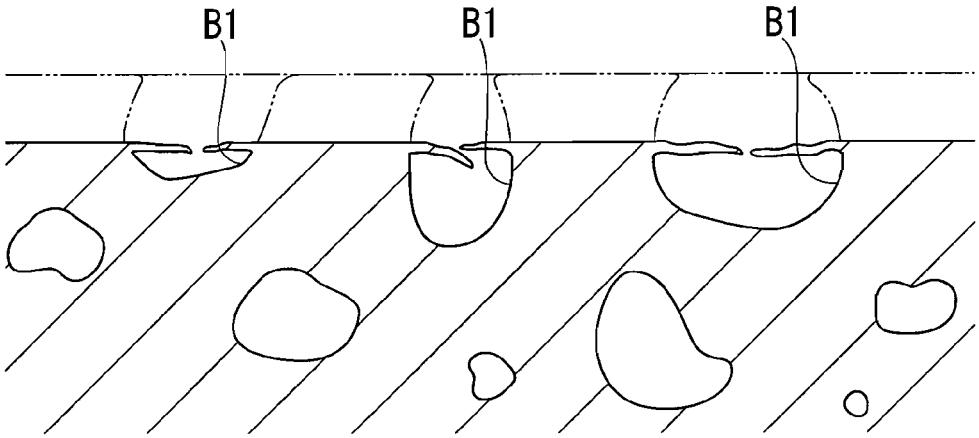
FIG. 4B is an enlarged cross-sectional view showing an outer circumferential surface of an outer pump rotor or both end surfaces of the outer pump rotor and an inner pump rotor of a prior art.

On the contrary, when the outer circumferential surface 30*b* and the end surfaces 20*a* and 30*a* are grinded, the ten point height of irregularities Rz decreases to be about 0.8 μm ore more to about 3.2 μm or less, and the holes B1 on the surfaces 30*b*, 20*a* and 30*a*, which open before the grinding process, are closed as shown in FIG. 4B, and the volume of the holes B1 decrease. Therefore, it becomes difficult to retain the part of the fluid B2 and to have an improved anti-galling like the present embodiment shown in FIG. 4A.

In addition, in the present embodiment, since the rotors 20 and 30 are formed from a sintered material of Fe—Cu—C and have a density of not less than 6.6 g/cm$^3$ and not more than 7.1 g/cm$^3$, the breaking strength and the surface durability of the rotors 20 and 30 can be secured to the necessary minimum, and the intersecting ridge portions 20*c* and 30*c* of the rotors 20 and 30 are crushed during the sizing process, thereby the chamfering amount of the ridge portions 20*c* and 30*c* can be decreased. As a result, it is possible to suppress the leakage of the fluid in the cells C to a gap between the end surfaces 20*a* and 30*a* and the inner surface 50*a* of the casing 50 from the intersecting ridge portions 20*c* and 30*c* when the internal gear pump 10 is activated and, thus, to make the cells C divided by the intersecting ridge portions 20*c* and 30*c*, the gear tooth surfaces, and the inner surface 50*a* of the casing 50 have high liquid-tightness.

Particularly, in the present embodiment, since the intersecting ridge portions 20*c* and 30*c* are not chamfered during the sizing process, and the rising amount Y in the direction of the rotation axes O1 and O2 from the end surfaces 20*a* and 30*a* becomes 0.01 mm or less and the protruding amount Z in the radius direction from the gear tooth surfaces becomes 0.05 mm or less, the intersecting ridge portions 20*c* and 30*c* can be in contact with the inner surface 50*a* of the casing 50 in the internal gear pump 10. As a result, the cells C are divided by the intersecting ridge portions 20*c* and 30*c*, the gear tooth surfaces, and the inner surface 50*a* of the casing 50, thereby it is possible to make the cells C have high light-tightness and to suppress the leakage of the fluid from inside of the cells C to the gap between the end surfaces 20*a* and 30*a* and the inner surface 50*a* of the casing 50 when the internal gear pump 10 is activated. Therefore, the fluid-carrying performance of the internal gear pump 10 can be improved.

Furthermore, since the rising amount Y is set in the above range, the intersecting ridge portions 20*c* and 30*c* of the end surfaces 20*a* and 30*a* are in contact with the inner surface 50*a* of the casing, partial wear does not easily occur on the inner surface 50*a*, therefore, the lifespan of the internal gear pump 10 is rarely shortened as a result of the partial wear.

Still furthermore, since the protruding amount Z is set in the above range, the intermediate portions of the rotors in the thickness direction can be prevented from not contacting with each other when the gears mesh with each other, while the intersecting ridge portions are in contact with each other. Therefore, the respective cells can be assuredly divided in the circumferential direction, and the fluid-carrying performance of the pump rarely deteriorates.

Still furthermore, in the present embodiment, since the rotors 20 and 30 are formed from the green compact Z1 formed by the powder-shaping device 100 shown in FIGS. 5 to 8, the precision of the size, that is, the thickness of the rotors 20 and 30 in the direction of the rotation axes O1 and O2 rarely deteriorates even when no grinding process is performed on the end surfaces 20*a* and 30*a* after the sizing process. Therefore, it is possible to exclude the grinding process from the fabrication process of the rotors 20 and 30 and to form the rotors 20 and 30 having the improved anti-galling efficiently with no deterioration of the precision.

Among the above effects, the anti-galling of the pump rotors was tested for verification.

The test pieces for this test were formed from sintered material of Fe—C—Cu containing at least 1.5 to 2.5% by weight of Cu and 0.6 to 0.75% by weight of C, and formed into disc-shape. These test pieces were processed by one of two processes (i.e., one is processed by grinding them after the sizing process, while the other is not processed by grinding after the sizing process). Five test pieces having different density and surface roughness Rz are prepared in the respective types (total of 10 examples).

The anti-galling load was measured for the respective test pieces. Herein, the anti-galling load was measured as follows: the test piece was disposed on the surface of a plate-shape test material (surface roughness 3.2 Rz) made of a FC material and then rotated around an axis thereof at the circumferential speed of about 3.1 m/s while a lubricant oil was supplied between the contacting surfaces of the test piece and the test material. At this process, loads were applied to the test piece step by step in the thickness direction, and a load was measured when a galling was generated on the contacting surface of the test piece. After that, the load was divided by the area of the contacting surface of the test piece.

Figure 9A:
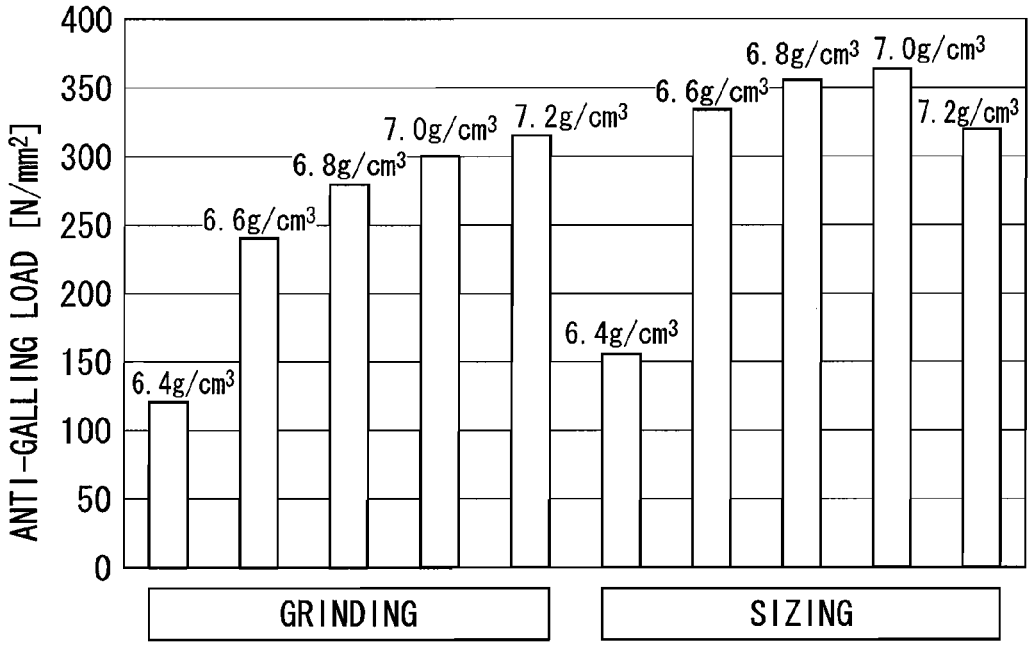
FIGS. 9A and 9B are graphs showing a test result of operations and effects of the pump rotor shown as the embodiment of the present invention.
Figure 9B:
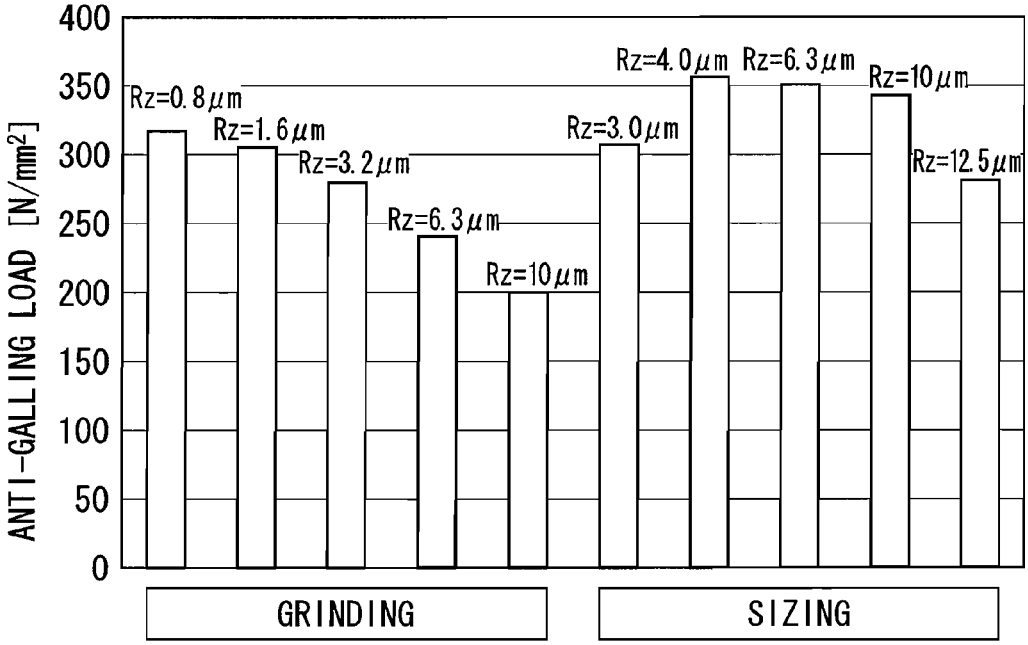

FIG. 9 illustrates the result. It was verified from the result that the anti-galling load can be improved if the test piece had the density of not less than 6.6 g/cm$^3$ and not more than 7.1 g/cm$^3$ and the ten point height of irregularities Rz of not less than 4 μm and not more than 10 μm.

Meanwhile, the technical scope of the present invention is not limited to the above embodiment, and can be modified in various manners within the spirit and scope of the present invention.

For example, the numbers of the outer gear teeth 21 and the inner gear teeth 31 are not limited to that of the above embodiment. Furthermore, even though the intersecting ridge portions 20*c* and 30*c* protrude with curved surfaces respectively in the above embodiment, the intersecting ridge portions 20*c* and 30*c* can be chamfered during the sizing process if the C (chamfering amount) is 0.2 mm or less.

In addition, the powder-shaping device 100 can employ the following construction instead of the construction shown in FIGS. 5 to 8.

Figure 10:
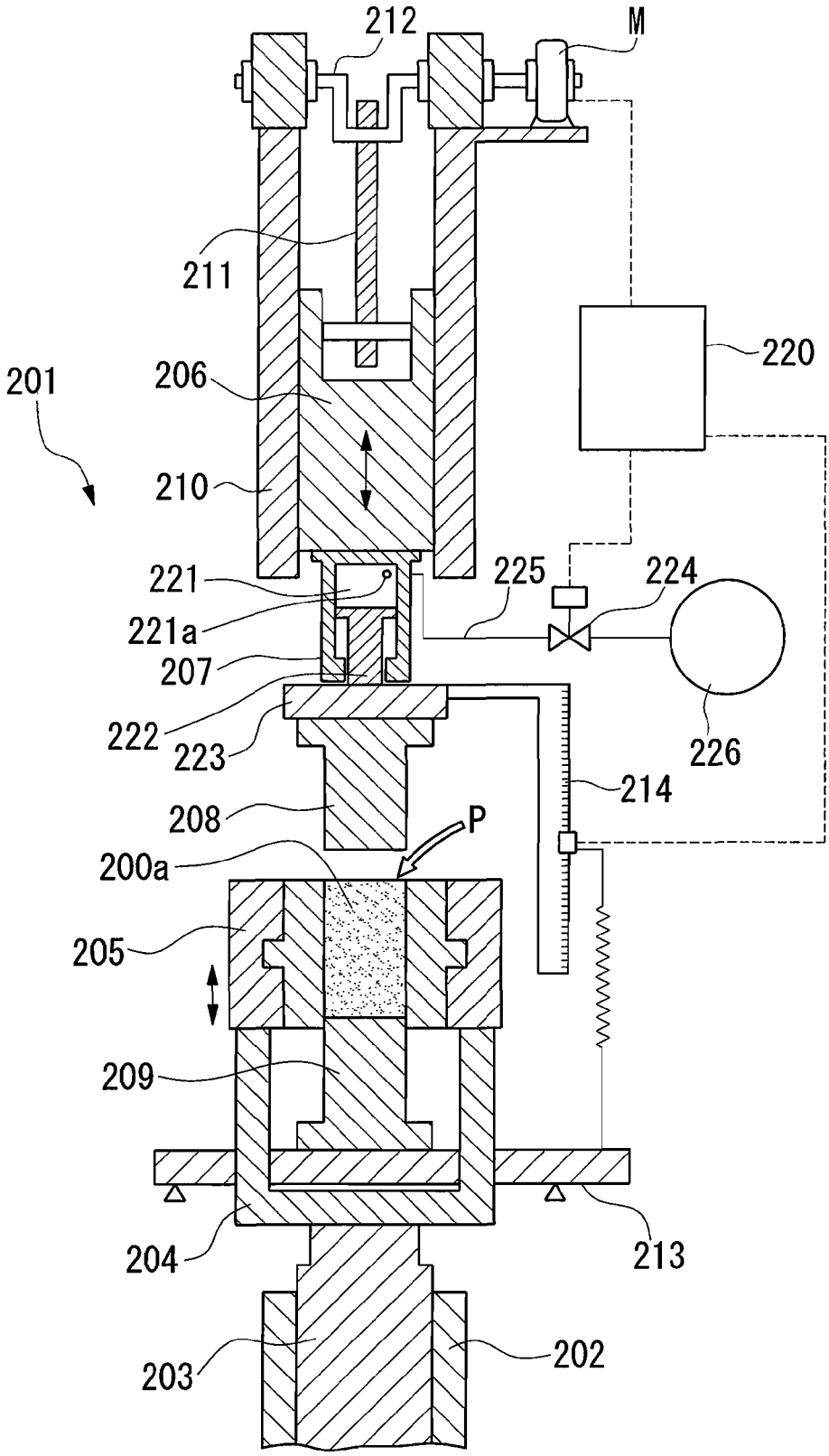
FIG. 10 is a view showing important parts of a powder-shaping device according to another embodiment for shaping the pump rotor shown in FIG. 1.

The construction of a CNC press device 201 will be described with reference to FIG. 10. The CNC press device 201 shown in FIG. 10 includes a die 205 having a cavity 200*a*, in which the material powder P is filled, an upper punch 208 and a lower punch 209. The die 205 and the upper punch 208 moves up and down respectively, and the lower punch 209 is fixed.

The die 205 is fixed to a lower slider 203 that slides in a lower guide 202 through a lower ram 204 and moved up and down by the driving of a driving unit (not shown) such as ball screw mechanism or the like. The lower punch 209 fixed to a fixing plate 213 is disposed under the die 205 and fitted into the cavity 200*a* from the bottom.

The upper punch 208 capable of entering the cavity 200*a* is disposed above the lower punch 209 while facing and coaxially with the lower punch 209. The upper punch 208 is attached to an upper guide 210 that slides in an upper slider 206 through an upper ram 207 including an oil hydraulic piston 222 to which an upper punch plate 223 is fixed to and an oil hydraulic cylinder 221. The upper slider 206 is coupled to a crank shaft 212 rotated by a driving motor M (first driving device) through a link mechanism 211. The driving motor M is a servo motor that is driven or stopped according to a program stored in a computer (control unit) 220.

The upper ram 207 includes the oil hydraulic cylinder 221 fixed to the upper guide 210 and the oil hydraulic piston 222 attached to the upper punch plate 223. An oil hydraulic supplying hole 221*a* is provided at the oil hydraulic cylinder 221, and hydraulic pressure is supplied from an oil hydraulic unit 226 (second driving device) through a hydraulic supplying pipe 225 connected to the oil hydraulic supplying hole 221*a*. Using a hydraulic servo valve 224 provided at the hydraulic supplying pipe 225 and driven by the computer 220, hydraulic control is performed.

That is, the upper ram 207 is driven up and down as a whole by the driving motor (first driving device) M, and the oil hydraulic piston 222 is driven up and down by the oil hydraulic unit (second driving device) 226.

In addition, the device 201 includes a linear scale (measuring unit) 214 between the upper punch plate 223, to which the upper punch 208 is fixed, and the fixing plate 213, to which the lower punch 209 is fixed, in order to measure the space between the upper punch plate 223 and the fixing plate 213. The measured value of the linear scale 214 is transmitted to the computer 220, and then the computer 22 calculates and outputs the driving signals of driving motor M and hydraulic servo valve 224 on the basis of the measured values.

The fabricating method of the green compact using the CNC press device 201 having the above construction will be described.

[Punch Driving Process]

The upper punch 208, the lower punch 209 and the die 205 are disposed at the initial predetermined positions before the pressure forming.

(First Driving Process)

The upper ram 207 is moved down to the bottom dead point (mechanically movable bottom position) while the lower punch 209 and the die 205 are fixed, and then the cavity 200*a* in which the material powder P filled is closed.

(Second Driving Process)

When the angle of the crank reaches 180°, at which the upper ram 207 reaches the bottom dead point, the driving motor M that mechanically drives the upper ram 207 is stopped by the computer 220, and then the upper punch 208 stops moving down along with the upper ram 207. In addition, the hydraulic servo valve 224 is driven as the upper ram 207 stops, and the oil hydraulic cylinder 221 is supplied with hydraulic pressure until the measured value of the linear scale 214 reaches the set value (the value when the thickness of the cavity 200*a* reaches the target value) in order to move down the oil hydraulic piston 222, that is, the upper punch 208 is moved down. Furthermore, the die 205 is moved down half as much as the lowering-stroke of the upper punch 208 as the upper punch 208 is moved down by hydraulic, thereby the material powder P in the cavity 200*a* is pressed from top and bottom, supplied uniform pressure, and compressed so as to have a vertically uniform density.

Furthermore, when the measured value of the linear scale 214 reaches the set value, the computer 220 controls the hydraulic servo valve 224, and the oil hydraulic piston 222 is moved up, thereby the upper punch 208 is moved up. In addition, the driving motor M restarts to rotate, and then the upper punch 208 is moved up in conjunction with the upper ram 207, and the die 205 is moved down. As a result, the green compact shaped as thick as the target value is removed from the die 205 (cavity 200*a*) and placed on the lower punch 209.

With the above method, the green compact shaped as thick as the target valve can be obtained.

According to the present invention, a pump rotor having an improved anti-galling can be obtained.

What is claimed is:

1. A pump rotor used in an internal gear pump including:

an inner pump rotor having outer gear teeth;

an outer pump rotor having inner gear teeth that mesh with the outer gear teeth; and a casing having a pumping-in port through which a fluid is pumped in, and a pumping-out port through which the fluid is pumped out, the pump rotor pumping in and pumping out the fluid by volume change of cells formed between gear tooth surfaces of the rotors so as to carry the fluid when the rotors mesh with each other and rotate, wherein the pump rotor is formed from a sintered material of Fe—Cu—C and has a density not less than 6.6 g/cm$^3$ and not more than 7.1 g/cm$^3$ and has a porosity of not less than 10% and not greater than 20%, and at least an outer circumferential surface of the outer pump rotor and both end surfaces perpendicular to rotation axes of the rotors are non-grinded surfaces and have ten point height of irregularities Rz not less than 4 μm and not more than 10 μm.

2. The pump rotor according to claim 1, wherein intersecting ridge portions between the end surfaces and the gear tooth surfaces have:

a rising amount of 0.01 mm in a direction of the rotation axes from the end surfaces; and a protruding amount of 0.05 mm in a radius direction from the gear tooth surfaces.

* * * * *